US005439139A

United States Patent [19]

Brovelli

[11] Patent Number: 5,439,139

[45] Date of Patent: Aug. 8, 1995

[54] TOY WATER GUN

[75] Inventor: Virginio Brovelli, Taino, Italy

[73] Assignee: Lanard Toys Limited, Hong Kong, Hong Kong

[21] Appl. No.: 189,583

[22] Filed: Jan. 31, 1994

[51] Int. Cl.[6] ..... A63H 3/18

[52] U.S. Cl. ..... 222/79; 222/255; 222/275; 222/278; 222/379

[58] Field of Search ..... 222/79, 278, 276, 255, 222/266, 270, 275, 378, 379; 42/54; 446/473

[56] References Cited

U.S. PATENT DOCUMENTS

| | | | |
|---|---|---|---|
| 869,246 | 10/1907 | Jones | 222/255 X |
| 1,733,635 | 10/1929 | Stork | 222/275 X |
| 4,436,230 | 3/1984 | Hofmann | 222/278 X |
| 5,029,732 | 7/1991 | Wong | 222/79 |
| 5,184,755 | 2/1993 | Brovelli | 222/79 |
| 5,316,183 | 5/1994 | Brovelli et al. | 222/78 |

FOREIGN PATENT DOCUMENTS

| | | | |
|---|---|---|---|
| 1610223 | 11/1990 | U.S.S.R. | 446/473 |
| 1631245 | 2/1991 | U.S.S.R. | 446/473 |
| 092022364 | 12/1992 | WIPO | 446/473 |

*Primary Examiner*—Andres Kashnikow
*Assistant Examiner*—Lisa Douglas
*Attorney, Agent, or Firm*—Brumbaugh, Graves, Donohue & Raymond

[57] ABSTRACT

A toy water gun comprises an elongated housing, a water reservoir attached to the housing, and two water pumps received in the housing. Each water pump includes a cylinder having a first end and a second end, a piston movable along the cylinder in sealing relation to the cylinder walls, and a piston rod coupled to the piston and extending out of the first end of the cylinder. An intake conduit for each water pump leads from the water reservoir to the second end of the cylinder and has a one-way intake valve that permits water to be drawn into the cylinder on an intake stroke of the piston. A discharge conduit for each water pump leads from the second end of the cylinder and includes a one-way discharge valve that permits water to be discharged from the cylinder on a delivery stroke of the piston. A nozzle is connected to each discharge conduit. An operating handle is received on the housing for movement relative to the pump cylinders and is coupled to the piston rods of both water pumps so as to simultaneously move the piston of one water pump along its delivery stroke and the piston of the other water pump along its intake stroke when moved in one direction and simultaneously move the piston of one water pump along its intake stroke and the piston of the other water pump along its delivery stroke when moved in another direction.

20 Claims, 4 Drawing Sheets

TOY WATER GUN

BACKGROUND OF THE INVENTION

Water guns have long been very popular toys. Most toy water guns have pumps that are manually operated, such as by a trigger that when pulled moves a piston along a cylinder in a discharge stroke to expel water from the cylinder and out through a one-way discharge valve and a discharge conduit to a nozzle. A spring moves the piston back along the piston in the opposite direction during an intake stroke in which water is drawn into the cylinder from a reservoir through a one-way intake valve and an intake conduit. The two-stroke cycle of a manually operated water gun results in an interruption of the water output; the gun shoots a small short-duration spurt of water on the delivery stroke of the piston and stops shooting upon each intake stroke of the piston.

A variant of the manually operated water gun that has enjoyed some popularity in recent years is the battery-operated water gun, which has a battery-powered motor that drives a reciprocating piston pump. The water output from battery-operated water guns is also intermittent, but the operating cycles and the delays between spurts are short so the water stream approaches that of a continuous flow. Battery-operated water guns are relatively expensive, and keeping them in batteries compounds the costs of owning one.

A very popular, relatively recent entry into the toy water gun market is the pressurized-air water gun. A manually operated air pump pumps air into a water tank. When a trigger valve is opened, the air pressure in the tank expels water from the tank through a discharge conduit and nozzle. As long as the pressure in the tank is elevated and for as long as the trigger valve is held open, the gun will shoot a continuous stream of water. As the pressure drops from a maximum, however, the strength of the emerging water stream and thus the range of the gun diminish. Maintaining a long range requires the user to operate the air pump frequently, and because it is cumbersome to keep the trigger pulled with one hand and operate the pump with the other, the gun is usually not operated simultaneously with pumping it up. In other words, the user has to interrupt his or her shooting to "reload." Air-pressurized water guns are also comparatively expensive.

SUMMARY OF THE INVENTION

One object of the present invention is to provide a water gun that shoots water substantially continuously when operated. Another object is to provide a continuously shooting water gun that is of relatively simple construction and that can, therefore, be made and sold at a low cost. Still another object is to provide a water gun in which the range of the essentially continuous water output is maintained at all times rather than diminishing with time of operation, as it does in pressurized-air water guns.

The foregoing objects are attained, in accordance with the present invention, by a toy water gun comprising an elongated housing, a water reservoir attached to the housing, and two water pumps received in the housing. Each water pump includes a cylinder having a first end and a second end, a piston movable along the cylinder in sealing relation to the cylinder walls, and a piston rod coupled to the piston and extending out of the first end of the cylinder. An intake conduit for each water pump leads from the water reservoir to the second end of the cylinder and has a one-way intake valve that permits water to be drawn into the cylinder on an intake stroke of the piston. A discharge conduit for each water pump leads from the second end of the cylinder and includes a one-way discharge valve that permits water to be discharged from the cylinder on a delivery stroke of the piston. A nozzle is connected to each discharge conduit. An operating handle is received on the housing for movement relative to the pump cylinders and is coupled to the piston rods of both water pumps so as to simultaneously move the piston of one water pump along its delivery stroke and the piston of the other water pump along its intake stroke when moved in one direction and simultaneously move the piston of one water pump along its intake stroke and the piston of the other water pump along its delivery stroke when moved in another direction.

In a preferred embodiment, the operating handle is mounted on the housing for reciprocating movement along a linear axis. The cylinders of the two water pumps are mounted with their axes parallel to the axis of movement of the operating handle, preferably with their axes aligned with each other, and with the first ends of the pump cylinders remote from each other and the second ends of the pump cylinders proximate to each other. The piston rods are coupled to the operating handle and to each other by a connecting rod.

The gun may be configured as a rifle, having a barrel portion and a stock portion. The housing includes a portion forming part of the stock portion and a portion forming the barrel. The operating handle is received on the portion of the housing forming the barrel for reciprocating movement. The water reservoir is configured as a portion of the stock.

In an advantageous arrangement, the water reservoir and the portion of the housing forming part of the gun stock have abutting wall portions. The intake conduits include flexible tubes that pass through openings in the abutting wall portions, and a gasket received between the abutting wall portions surrounds the flexible tubes in sealed relation.

The intake conduits may include flexible tubes having portions received in the water reservoir, each tube having an inlet end. The water reservoir includes a partition wall shaped to retain the inlet ends of the tubes in a lowermost portion of the water reservoir so that they are always immersed until the water in the reservoir is nearly depleted. Each intake conduit may include an intake fitting attached to the intake end of the tube, each intake fitting incorporating the intake valve for the pump to which that conduit is connected.

It is preferred to have the discharge valve of each discharge conduit proximate to the nozzle. For example, the discharge valve and nozzle of each discharge conduit may be components of a sub-assembly. Having the discharge valve as part of the nozzle simplifies the design of the pump cylinder, and having it remote from the pump cylinder conserves space in the region of the cylinder. An efficient arrangement of the components within the housing from the point of view of effectively using available space involves locating the connecting rod on one side laterally of the pump cylinders, locating one discharge conduit in an upper portion of the housing, and locating the other discharge conduit in a lower portion of the housing.

The housing, in a preferred form, includes a guideway that slidably supports the connecting rod, the guideway being in one of two housing side members that are joined together along mating edges and define a compartment for the pumps, the connecting rod and the discharge conduits. One of the side members includes guide flanges that slidably support the connecting rod, and a retainer member is attached to that side member and includes guide wall portions defining with the guide flanges the guideway for the connecting rod. The retainer member may have cylinder retainer flange portions supporting the cylinders in conjection with portions of the other housing side member.

The gun is used by gripping the stock with one hand, preferably bracing the end of the stock against the body, gripping the operating handle with the other hand, and pulling back and forth on the operating handle. Each backward stroke of the handle simultaneously moves the piston of one pump toward the discharge end of the cylinder and expels water from that cylinder and moves the piston of the other pump away from the discharge end of the cylinder and takes water into that cylinder from the reservoir. Each forward stroke of the handle reverses the strokes of the two pumps. At the end of each stroke of the handle, there is an interruption in the water output of the gun as the handle stops briefly before being moved in the reverse direction, but the interruption is of relatively short duration and is hardly perceptable to either the user or the target.

For a better understanding of the invention, reference may be made to the following description of an exemplary embodiment, taken in conjunction with the accompanying drawings.

DESCRIPTION OF THE EMBODIMENT

Figure 1:
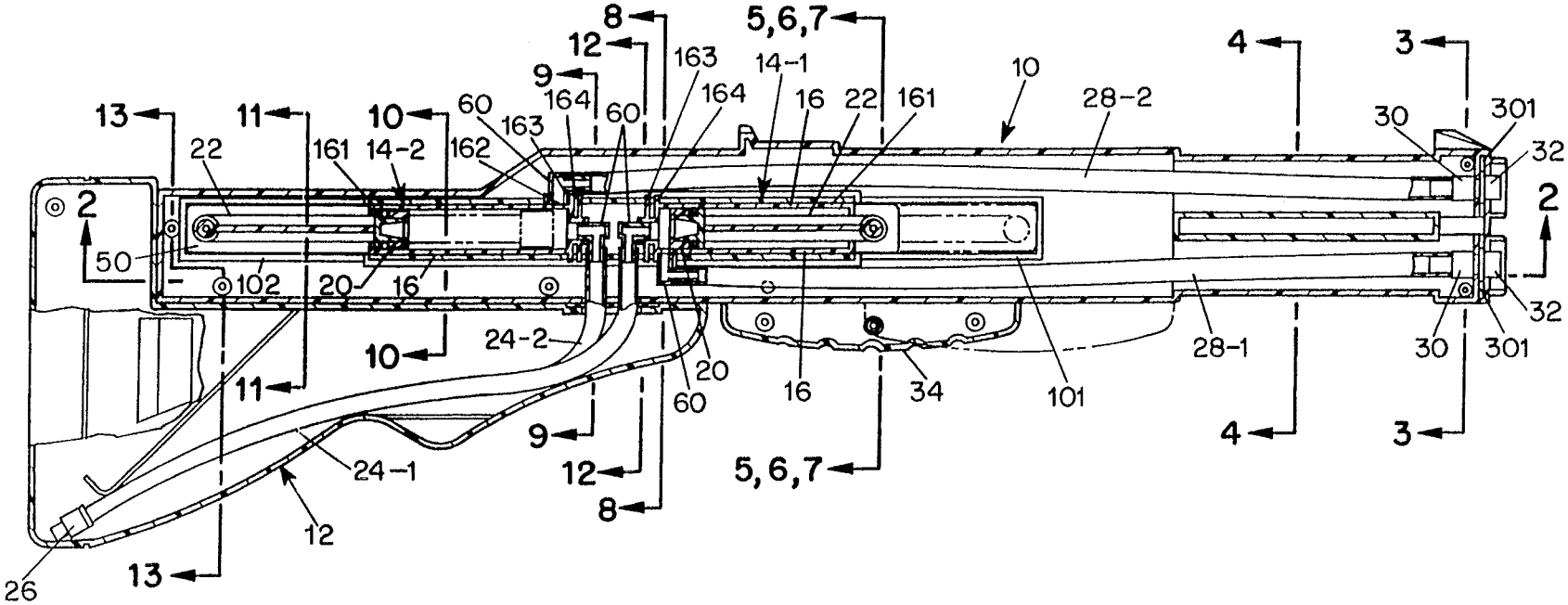
FIG. 1 is a side elevational view of the embodiment, showing it with the near side members of the reservoir and housing removed and showing some of the components cut away in cross-section.
Figure 2:
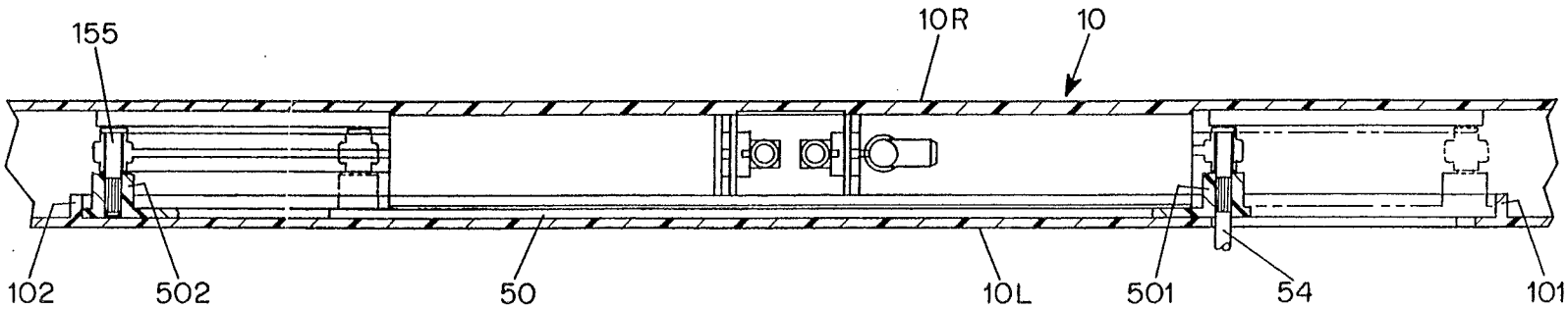
FIG. 2 is a bottom cross-sectional view taken along the line 2—2 of FIG. 1.
Figure 3:
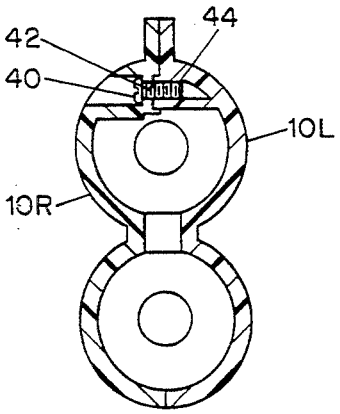
FIGS. 3 to 13 are end cross-sectional views of the embodiment, taken along the correspondingly numbered section lines of FIG. 1; some of the sectional views are simplified or fragmentary or both.
Figure 4:
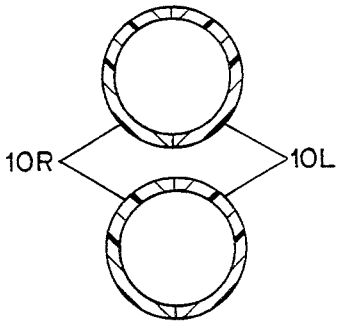
Figure 8:
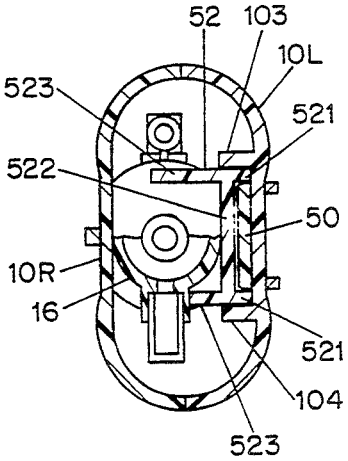

The embodiment comprises an elongated housing 10, a water reservoir 12 attached to the housing, and two identical water pumps 14-1 and 14-2 received in the housing. Each water pump 14-1, 14-2 includes a cylinder 16 having a first or rod 161 end and a second or discharge end 162, a piston 20 movable along the cylinder in sealing relation to the cylinder walls, and a piston rod 22 integral with the piston and extending out of the rod end of the cylinder. An intake conduit 24-1, 24-2 for each water pump leads from the water reservoir 12 to the discharge end 162 of the cylinder and has a one-way intake valve 26 that permits water to be drawn into the cylinder on each intake stroke of the piston. A discharge conduit 28-1, 28-2 for each water pump leads from the discharge end of the cylinder and includes a one-way discharge valve 30 that permits water to be discharged from the cylinder on a delivery stroke of the piston. A nozzle 32 is connected to each discharge conduit 28-1, 28-2. An operating handle 34 is received on the housing for movement relative to the pump cylinders 16 and is coupled to the piston rods 22 of both water pumps so as to simultaneously move the piston of one water pump along its delivery stroke and the piston of the other water pump along its intake stroke when moved in one direction and simultaneously move the piston of one water pump along its intake stroke and the piston of the other water pump along its delivery stroke when moved in another direction.

The housing 10 is composed of two parts 10L and 10R (left and right locking from the butt and toward the nozzle end) that mate along their edges at approximately the vertical/longitudinal center plane of the gun and are joined by several screws 40 (e.g. FIG. 13) that pass through inset holes 42 in one housing part 10R and thread into screw bosses 44 in the other housing part 10L. The gun is configured as a rifle, the water reservoir 12 and a rear part of the housing 10 forming a stock portion and the front end of the housing forming double barrels. The configuration may, of course, be varied and is to a large extent a matter of achieving a desired appearance.

The left housing part 10L is configured to receive and retain in position the two pumps 14-1 and 14-2 and a connecting bar 50 that connects the piston rods 22 to each other. Ribs 101 and 102 extending inwardly and of U-shape in plan form end portions of a longitudinal guideway for the connecting bar. Inwardly extending, longitudinal ribs 103 and 104 on the housing part 10L above and below the pumps 14 accept an elongated, box-like retainer member 52, which has flange portions 521 on its laterally outward side that form an intermediate portion of the connecting bar guideway, a web portion 522 that covers the guideway and retains the connecting bar, and side wall portions 523 forming cavities for reception of the pump cylinders 16. The side wall portions 523 have slots that receive flanges 163, 164 on the pump cylinders 16 and elbow fittings (described below) for the pump inlet and discharge conduits. The reception of the cylinder flanges 163, 164 in the slots locates and holds the respective pump cylinders in position longitudinally.

Figure 5:
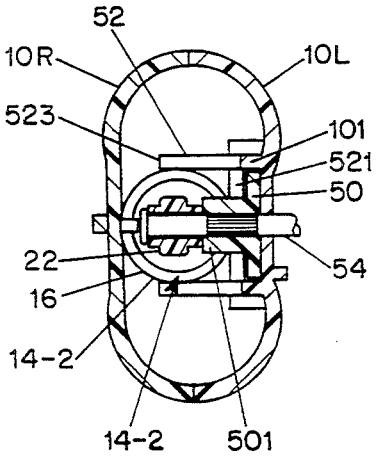
Figure 6:
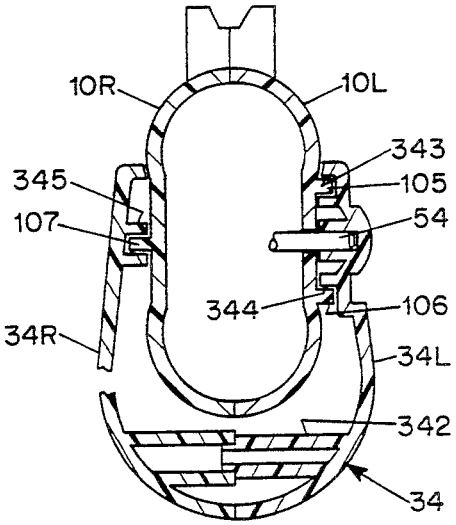
Figure 7:
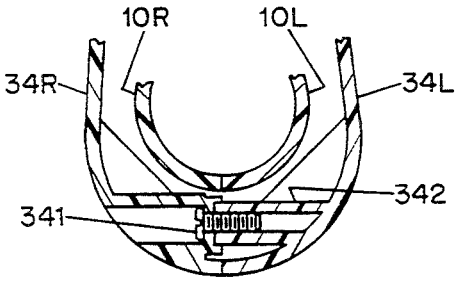
Figure 10:
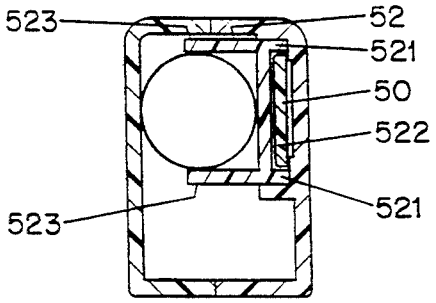
Figure 11:
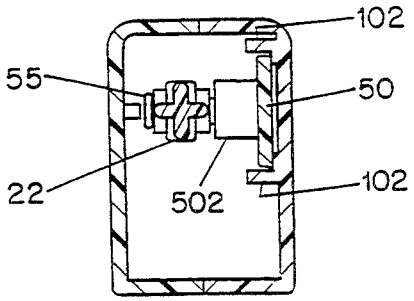

The handle 34 is composed of two parts 34L and 34R joined by screws 341 received in screw bosses 342 (see FIG. 7), is generally U-shaped as viewed from the end, and has its leg portions straddling the housing. Longitudinal internal slots 343, 344 and 345 on the handle parts mate with with longitudinal external ribs 105, 106 and 107 on the housing parts to both retain and guide the handle on the housing (FIG. 6). The handle 34 is connected to the piston rod 22 of the pump 14-2 and to a boss portion 501 of the connecting bar 50 by a pin 54 (FIGS. 5 and 6). The piston rod 22 of the other pump 14-1 is connected to a boss portion 502 of the connecting rod by a pin 55 (FIG. 11).

Figure 9:
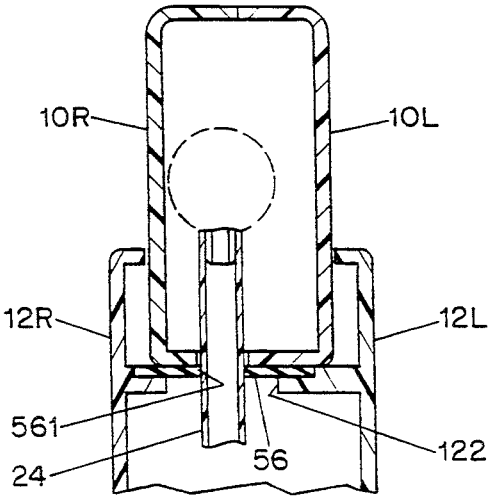
Figure 12:
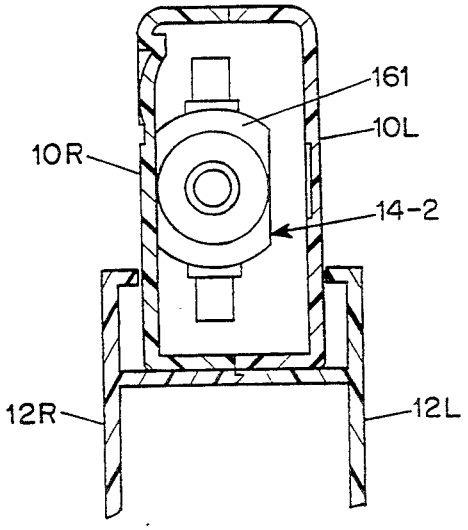
Figure 13:
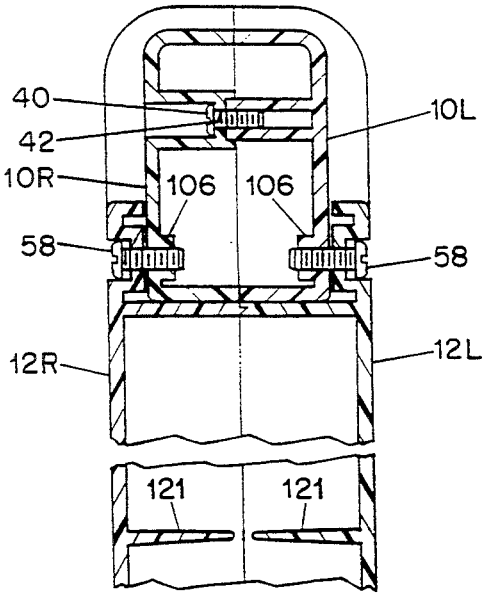

Referring to FIGS. 9, 12 and 13, the water reservoir 12 is assembled from two parts 12L and 12R that mate along edges and are joined to be water tight, preferably by ultrasonic welding. An internal partition wall 121 guides the intake tubes 24 to the lower part of the reservoir at assembly of the gun and keeps them there throughout the life of the gun (See FIG. 1). The tank has a recessed opening 122 for the tubes 24, and a gasket 56 having holes 561 that tightly fit the tubes is glued into the recess (FIG. 9). Flanges 123 along the the sides of the upper front part of the tank accept screws 58 that thread into screw bosses 106 on the housing 10 to fasten the tank to the housing (FIG. 13).

Figure 15:
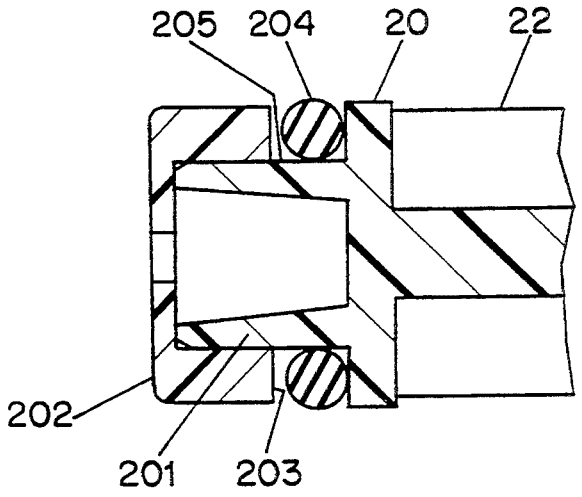
FIG. 15 is a detail view of the piston portion of each pump.

Special care has been taken in the embodiment to ensure against leakage of the one-way intake and discharge valves 26 and 30 and between the pistons 20 and cylinders 16 of the pumps, thereby to maintain high efficiency in the pump system. As shown in FIG. 15, the piston 20 of each pump 14-1, 14-2 is composed of a body part 201 that is integral with the piston rod 22 and a separate ring retainer part 202. The body part 201 and retainer part 202 define a ring groove 203 that receives the sealing ring 204, and the body part has a circular cylindrical ringland surface 205 that is engaged by the sealing ring and that is entirely smooth and free of any mold-parting lines. In this regard, the piston member 20 is injection molded in a three-part mold, the surface 205 being formed in a cavity in a mold part that has an annular groove matching the shape of the annular portion that forms the surface 205 and from which the piston member parts in the axial direction. The smooth ringland 205 ensures against leakage, thereby improving the pumping efficiency of the pump.

The ring retainer part 202 of the piston 20 is attached to the body part 201 solely by a press-fit—i.e, no adhesive or bonding material is used. The reliability of manufacture of the toy is enhanced, inasmuch as the chance of an adhesive rendering the sealing ring 204 partly inoperative by presenting an irregular surface or altering its compressibility is eliminated.

Each water inlet valve 26 (see FIG. 14) includes a coupling member 261 that is received within the end of the inlet tube 24 and has a hole 262 opening to the tube. A valve body member 263 is joined to the coupling member and has a port 264 bounded by an annular rib 265 that serves as a valve seat portion. The coupling member and body member define a compartment 266, and an elastomeric valve disc 267 is received in the compartment with clearance for water flow and for movement into and out of engagement with the valve seat portion. On the intake stroke of the pump, the disc 267 moves out of engagement with the valve seat 265 so that water can flow through the port. The circumferential clearance between the disc 267 and the walls of the chamber 266 and notches 268 in the end of the coupling member 261 permit the water to flow through the valve to the passage hole 262 and thence through the tube 24 to the pump.

The coupling member 261 and body member 263 of the inlet valve are joined telescopically solely by a friction fit, thereby enhancing reliability of the inlet valve by eliminating the need for a bonding material which, if not correctly applied during manufacture, could render the valve inoperative. This feature eliminates an important source of potential manufacturing defects.

The body member 263 includes a filter **263*a* located upstream, with respect to water flow direction from the reservoir to the valve port. The filter, which is a series of slits 263*b* molded into the body member 263**, prevents particulate material from getting into the intake valve or the pump, which would most likely sooner or later ruin the toy.

Figure 14:
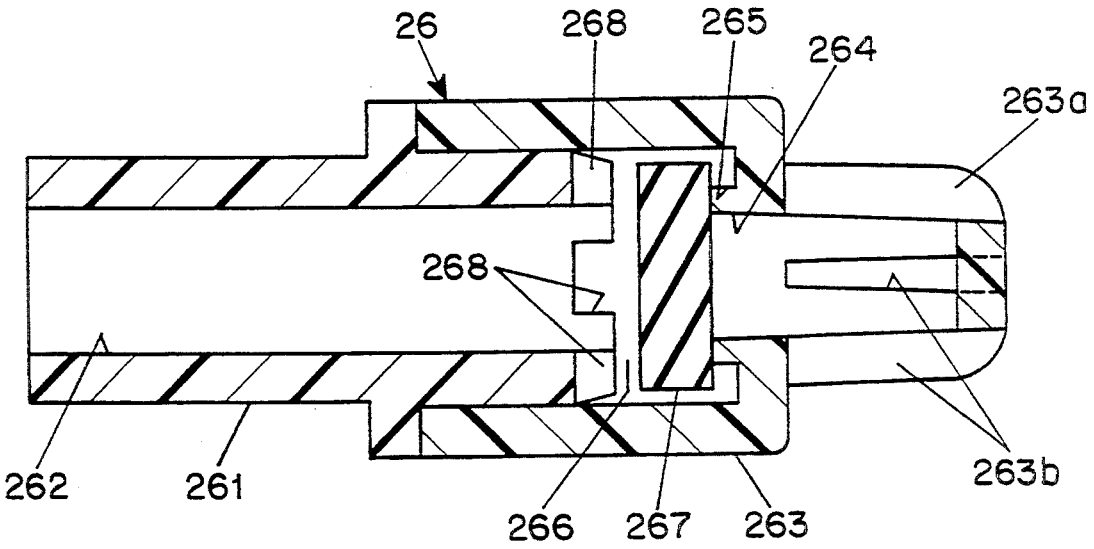
FIG. 14 is a detail cross-section of the one-way water inlet valve.

Each one-way discharge valve 30 of the water gun is of the same construction as the inlet valve shown in FIG. 14, except that the body part has a nozzle 32 formed downstream from the seat instead of a filter and also has a flange 301 that is received in grooves in the housing parts that hold to valve/nozzle 30/32 in place.

The intake and discharge tubes 24 and 28 are connected to the pumps 14-1 and 14-2 by elbow fittings 60 that are affixed to sockets formed by annular flanges on the pump cylinders. The only difference between the two pumps is that the elbow fittings are installed in rotationally different orientations so that the inlet fittings have inlet arm portions that point down and the discharge fittings have outlet arms that both point toward the nozzle end of the barrel when the pumps are installed in the housing.

Assembly of the gun is easy because of the design, which helps keep production costs low. The assembly steps are:

- assemble valves, piston/piston rods, and cylinders;
- install pistons in cylinders and connect valves to tubes and tubes to cylinders;
- position cylinders and connecting bar in retainer and attached connecting bar to piston rods;
- seat piston/connecting bar/retainer unit in left housing part and seat discharge valves in grooves of left housing part;
- install right housing part on left housing part and fasten with screws;
- install and fasten handle parts;
- insert water inlet tubes in previously completed tank and fasten tank to housing.

The water gun is operated by pushing and pulling the handle back and forth along the housing. When the handle is pushed forward (toward the nozzles), the piston of the rear pump 14-2 is pushed forward to discharge water taken into it on the previous pulling stroke of handle, and the piston of the front pump 14-1 is simultaneously pushed forward to induct water from the reservoir. When the handle is pulled back, water is discharged from the front pump 14-1 and inducted into the rear pump 14-2. Each stroke of the handle provides delivery, so the water output of the gun is virtually continuous when the handle is moved back and forth continuously, except for very brief interruptions at the end of each stroke. On the other hand, the user may pause between strokes, thereby producing intermittent shots or single shots at long intervals, as desired. The double-pumping action of the gun permits very rapid intermittent firing or continuous firing, which is not possible with manual single pump water guns because of finite time delays between firings resulting from water induction on one stroke of the pump. Water guns that use springs to drive the induction stroke usually have long delay times between firings, because the spring force is kept low so as not to provide a large force resisting a manual delivery stroke.

I claim:

1. A toy water gun comprising an elongated housing, a water reservoir attached to the housing, a first water pump received in the housing, a second water pump received in the housing, each water pump having an elongated cylinder having a first end and a second end and a longitudinal axis, a piston movable along the cylinder in sealing relation to the cylinder walls, and a piston rod coupled to the piston and extending out of the first end of the cylinder, an intake conduit for each water pump leading from the water reservoir to the second end of the respective cylinder and having a one-way intake valve that permits water to be drawn into the respective cylinder on an intake stroke of the respective piston, a discharge conduit for each water pump leading from the second end of the respective cylinder and including a one-way discharge valve that permits water to be discharged from the respective cylinder on a delivery stroke of the respective piston, a nozzle connected to each discharge conduit and affixed to the housing, an operating handle received on the housing for movement relative to the pump cylinders and coupled to the piston rods of both water pumps so as to simultaneously move the piston of one water pump along its delivery stroke and the piston of the other water pump along its intake stroke when moved in one direction and simultaneously move the piston of said one water pump along its intake stroke and the piston of said other water pump along its delivery stroke when moved in another direction.

2. A toy water gun according to claim 1 wherein the operating handle is mounted on the housing for reciprocating movement along a linear axis.

3. A toy water gun according to claim 2 wherein the cylinders of the first and second water pumps are mounted with their longitudinal axes parallel to the axis of movement of the operating handle.

4. A toy water gun according to claim 3 wherein the cylinders of the two water pumps are mounted with their longitudinal axes aligned with each other.

5. A toy water gun according to claim 3 wherein the first ends of the pump cylinders are remote from each other and the second ends of the pump cylinders are proximate to each other.

6. A toy water gun according to claim 5 wherein the piston rods are coupled to the operating handle and to each other by a connecting rod.

7. A toy water gun according to claim 1, the gun being configured as a rifle and having a barrel portion and a stock portion, wherein the housing includes a portion forming part of the stock portion and a portion forming the barrel.

8. A toy water gun according to claim 7, wherein the operating handle is received on the portion of the housing forming the barrel for reciprocating movement.

9. A toy water gun according to claim 7 wherein the water reservoir is configured as a portion of the stock portion.

10. A toy water gun according to claim 9 wherein the water reservoir and the portion of the housing forming part of the stock portion have abutting wall portions, the intake conduits include flexible tubes that pass through openings in said wall portions, and further comprising a gasket received between said abutting wall portions and surrounding the flexible tubes in sealed relation.

11. A toy water gun according to claim 1 wherein the intake conduits include flexible tubes having portions received in the water reservoir, each tube having an inlet end, and wherein the water reservoir includes a partition wall shaped to retain the inlet ends of the tubes in a lowermost portion of the water reservoir.

12. A toy water gun according to claim 11 wherein each intake conduit includes an intake fitting attached to the intake end of the tube, each intake fitting incorporating the intake valve.

13. A toy water gun according to claim 1 wherein the discharge valve of each discharge conduit is proximate to its respective nozzle.

14. A toy water gun according to claim 13 wherein the discharge valve and nozzle of each discharge conduit are components of a sub-assembly.

15. A toy water gun according to claim 6, the gun being configured as a rifle and having a barrel portion and a stock portion, wherein the housing includes a portion forming part of the stock portion and a portion forming the barrel, the operating handle is received on the portion of the housing forming the barrel for reciprocating movement, the connecting rod is located in the housing laterally of the pump cylinders, one discharge conduit is located in an upper portion of the housing and the other discharge conduit is located in a lower portion of the housing.

16. A toy water gun according to claim 6, wherein the pumps are identical and interchangeable.

17. A toy water gun according to claim 6, wherein the housing includes a guideway that slidably supports the connecting rod.

18. A toy water gun according to claim 17, wherein the housing includes two side members joined together along mating inside edges, and one of the side members includes guide flanges that partly define a guideway and slidably support the connecting rod.

19. A toy water gun according to claim 18, wherein the housing further includes a retainer member, the retainer member being attached to said one side member and including guide wall portions defining with the guide flanges said guideway for the connecting rod.

20. A toy water gun according to claim 19, wherein the retainer member includes cylinder retainer flange portions supporting the cylinders.

* * * * *